United States Patent [19]

Andersson

[11] 4,162,702

[45] Jul. 31, 1979

[54] DEVICE FOR DIVIDING THE FLOW IN A HEAT EXCHANGER

[75] Inventor: Sven E. A. Andersson, Sodertalje, Sweden

[73] Assignee: AB Svenska Maskinverken, Jarfalla, Sweden

[21] Appl. No.: 782,555

[22] Filed: Mar. 29, 1977

[51] Int. Cl.[2] ..... F28D 7/12

[52] U.S. Cl. ..... 165/142; 165/160; 165/163

[58] Field of Search ..... 165/160, 142, 172, 164, 165/162, 163

[56] References Cited

U.S. PATENT DOCUMENTS

| | | | |
|---|---|---|---|
| 2,267,695 | 12/1941 | Graham | 165/142 |
| 2,491,618 | 12/1949 | Luetzelschwab | 165/142 |
| 2,578,917 | 12/1951 | Bisch | 165/164 X |
| 2,803,440 | 8/1957 | Simpelaar | 165/160 X |
| 2,956,787 | 10/1960 | Raub | 165/160 X |
| 3,074,480 | 1/1963 | Brown, Jr. et al. | 165/160 X |
| 3,330,336 | 7/1967 | Göbel | 165/160 |
| 3,616,849 | 11/1971 | Dijt | 165/160 X |
| 3,963,071 | 6/1976 | Levin et al. | 165/142 |

*Primary Examiner*—Ira S. Lazarus

*Attorney, Agent, or Firm*—Haseltine, Lake & Waters

[57] ABSTRACT

The structure of the present invention employs a device at a heat exchanger for two media having parallel tubes with surface enlarging pins and passing through one of the media and about the second medium in a direction substantially parallel to the first medium where the tubes are positioned in a casing with a chamber at each end. Filler material is provided in the spaces between the tubes and the casing. The filler material is hollow at its ends and opens each into a chamber which is positioned in the casing.

7 Claims, 7 Drawing Figures

DEVICE FOR DIVIDING THE FLOW IN A HEAT EXCHANGER

This invention relates to a device at heat exchangers for two media, comprising parallel tubes with surface-enlarging pins and flown through by one of the media and flown about by the second medium in a direction substantially in parallel with the first medium, which tubes are positioned in a casing having a chamber at each end and are so arranged, that the longitudinal passageways with projecting pins between the tubes connect the two chambers, and filler bodies are provided in the spaces between the tubes and the casing having no projecting pins.

The invention has the object of rendering it possible to divide or collect the flow of the medium flowing about the tubes without using external conduits, i.e. conduits extending outside the casing as at conventional exchangers where they are annoying from economic as well as thermo-technical aspects.

In order to achieve said object, the device according to the invention has been given the characterizing features defined in the attached claims.

In addition to the aforesaid object, several more advantages are obtained with the invention. The casing of the heat exchanger can be shortened, because no space is required for the outlet connecting piece for the medium flowing about the tubes, which connecting piece must be provided at conventional exchangers where the connecting pipe is located on the outside. The filler body or bodies are loosely inserted and, therefore, do not give rise to stress when their temperature differs from that of the casing. The heat exchanger in its entirety requires less space than conventional ones.

Figure 1:
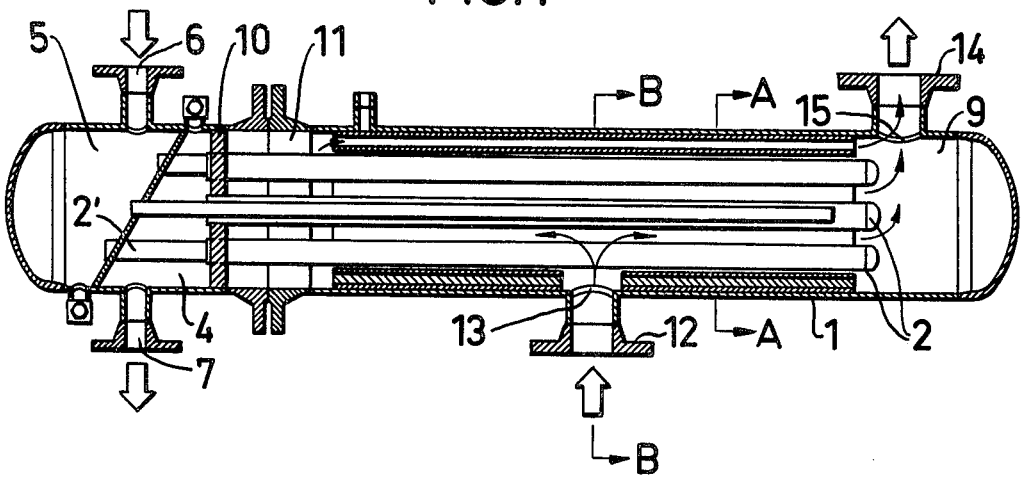
Figure 2:
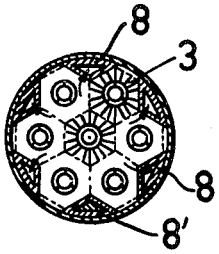
Figure 3:
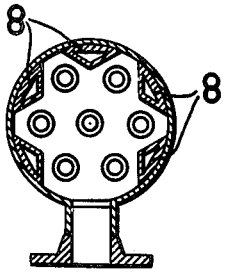
Figure 4:
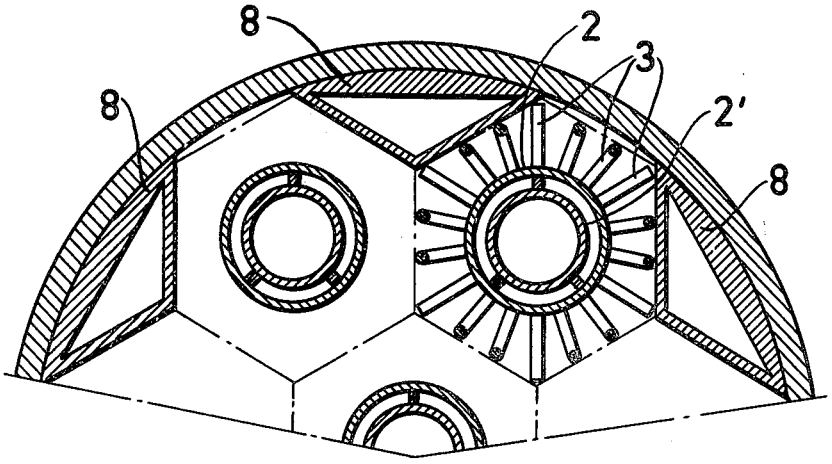
Figure 5:
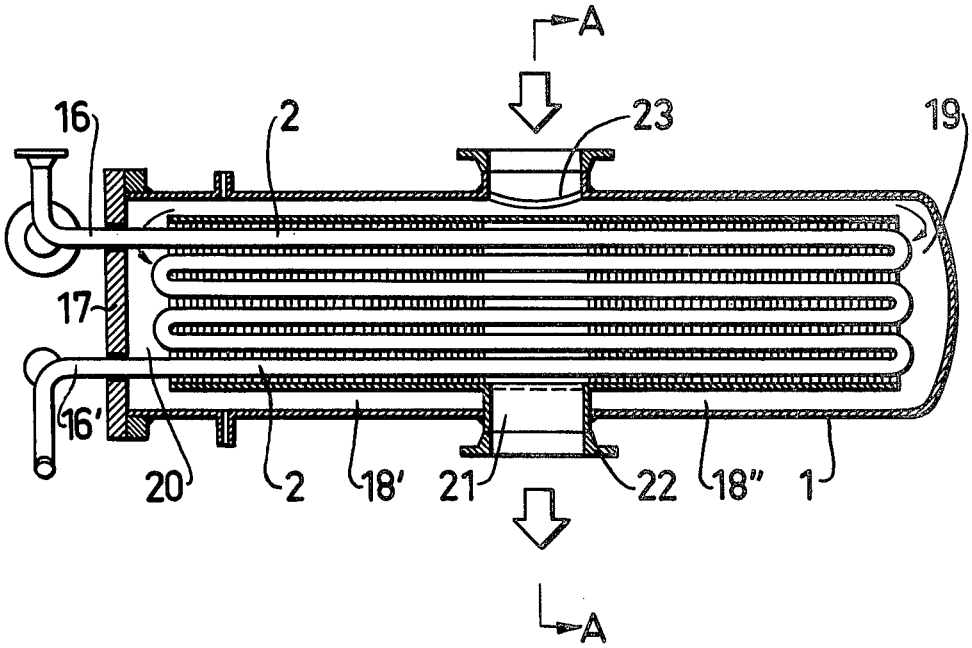
Figure 7:
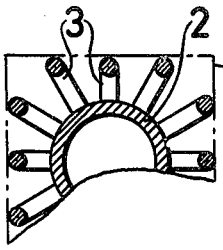
Figure 6:
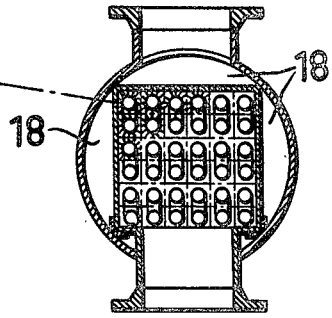

Two embodiments of the invention are described in the following, with reference to the accompanying drawings, in which FIG. 1 is a longitudinal section through a heat exchanger according to the invention, FIG. 2 is a section along the line A—A in FIG. 1, FIG. 3 is a cross-section along the line B—B in FIG. 1, FIG. 4 is a partial section of the cross-section according to FIG. 2 on an enlarged scale, FIG. 5 is a longitudinal section through a second embodiment of the invention, FIG. 6 is a cross-section along the line A—A in FIG. 5, and FIG. 7 is an enlargement of a portion of the cross-section according to FIG. 6.

The heat exchanger according to FIG. 1 comprises a casing 1, in which a plurality of tubes 2 are enclosed which are provided with surface-enlarging pins 3. See particularly FIG. 4. At the embodiment according to FIG. 1, the tubes 2 are double tubes, with an inner tube 2', and the tube 2 is closed at its right-hand end while the left-hand end is open in an outlet chamber 4. The inner tube 2' of each tube unit opens into an inlet chamber 5. The heat-emitting medium flows through the inlet 6 into the inlet chamber 5, through the inner tubes 2' and turns back at the right-hand end of the tubes 2 in FIG. 1 and is returned to the outlet chamber 4 for flowing out through the outlet 7. It was, as stated, the heat-emitting medium which flows through the tubes 2 but, of course, it may also be heat-receiving medium which flows within the tubes.

The second medium (heat-receiving or heat-emitting medium) is to be led so in the heat exchanger, that it flows about the tubes 2 and pins 3. As is apparent from FIG. 2, the entire inner cross-section of the heat exchanger is covered by the tubes 2 and pins 3, and the areas between the ends of the pins and the inner surface of the casing 1 where no pins can be provided is occupied by filler bodies 8. As appears from FIG. 1, to the right of the ends of the tubes 2 a chamber 9 is located. In connection to the outlet chamber 4 a tube sheet 10 is provided, through which the tubes 2 extend and to which they are sealingly attached. As can be seen in FIG. 1, a further chamber 11 is provided at the left-hand end of the tubes 2, but before the tube sheet 10. Said chamber 11 is formed thereby that the filler bodies 8 terminate their extension before the tube sheet and thereby form between the tubes and the inner surface of the casing 1 a space without filler bodies.

According to the idea of the invention, a free flow connection between the chambers 9 and 11 is established thereby that the filler bodies 8 are hollow and can pass medium from the chamber 11 to the chamber 9, or vice versa. At the embodiment shown in FIGS. 1–4, all filler bodies are designed open at the ends and hollow, except for the filler body 8' located farthest at the bottom of the heat exchanger. Said filler body 8' is closed and divided into two parts, so that a connection between the outside of the casing and the interior of the heat exchanger can be established. As seen in FIG. 1, an inlet connecting piece 12 for the medium flowing about the tubes is provided approximately at the middle of casing 1. The inlet connecting piece is connected to the casing through an opening 13. The filler body 8', as also can be seen, is divided directly in front of said opening, thereby providing free entrance to the interior of the heat exchanger. The pins preferably also are removed from the tubes in the cross-sectional area directly in front of the opening 13. An outlet connecting piece 14 is connected to the chamber 9 via an opening 15.

The second medium (heat-receiving medium) flows in through the connecting piece 12 and opening 13 and into the interior of the heat exchanger over the entire cross-section, because the tubes 2 have no pins in this area. The medium then separates into two streams, one to the right and one to the left, and the stream flowing to the right is collected in the chamber 9. The medium stream flowing to the left is collected in the chamber 11 and then is to be re-united with the medium stream in chamber 9, which re-union takes place thereby that the medium can flow freely through the hollow filler bodies 8. The medium, thus, is divided into two streams, one to the right and one to the left, and the re-union takes place in the chamber 9, whereafter the entire medium amount can flow out through the opening 15. The opening 15, of course, and the outlet connecting piece 14 can be positioned in connection to the chamber 11, without thereby changing the function of the invention, but for practical reasons at one embodiment they have been positioned in connection to the chamber 9. It is understood, further, that the flow direction of the medium can be changed so that the inflow takes place through the opening 15 and the outflow through the opening 14.

From FIGS. 2–4 is apparent that the cross-section of the tubes 2 with the pins 3 is uniformly hexagonal, and hereby as previously known filler bodies between the tubes are eliminated, but the filler bodies 8 have been positioned between the pins and the inner surfce of the casing. Other cross-sectional shapes for the area covered by the tubes 2 and pins 3, of course, are possible and the cross-sectional shape of the filler bodies is to be adjusted thereto.

In FIGS. 5–6 a second embodiment of the invention is shown. This embodiment differs from previous embodiments with respect to the tubes thereby, that the tubes 2 are positioned and designed in a winding manner, so that the tubes are single with one inlet end 16 and one outlet end 16′ through the end wall sheet 17. Surface-enlarging pins 3 are provided in the same manner as at the previous embodiment, but as appears from FIGS. 6 and 7 the pins are so bent or cut off, that the cross-section over one tube and the pins has become square. The entire cross-section for the tube bundle thereby also is square, as can be seen in FIG. 6, and four pieces of filler bodies 18 are provided between the tubes and the inner surface of the casing. The filler bodies 18 terminate slightly spaced from both ends of the casing, so that chambers 19 and 20 are formed at both ends of the heat exchanger. The lower one of the filler bodies 18 is divided in the same way as the previous embodiment into a left-hand and a right-hand part 18′ and 18″ thereby, that an outlet opening 21 with a connecting piece 22 extends from the interior of the heat exchanger and through the casing. Also at this embodiment the pins are removed from the tubes 2 in the cross-sectional area directly in front of the opening 21. The inlet for the medium flowing about the tubes is located directly in front of the opening 21 and designated by 23. The medium flowing about the tubes enters through the opening 23 and is distributed to the left and right through connection with the upper hollow filler body 18, which is open at the ends and, thus, the medium is passed to the two chambers 19 and 20. From said chambers the medium continues to flow in between the tubes 2 and pins 3 and to the centre of the heat exchanger where the two medium streams meet and flow out through the opening 21. The second medium (heat-emitting or heat-receiving) flows in into the tubes 2 through the inlet end 16 and passes through all tubes by turn and out through the outlet end 16′. The tubes 2, alternatively, can be arranged in screens, for example vertical screens, so that the inflow takes place in the upper one and the outflow through the lower one of the tubes. The inlets and outlets are connected to distribution boxes and collecting boxes, respectively.

A particularly suitable application of the invention is related to the heating of oil. The oil is passed into the centre of the heat exchanger and distributed over the entire cross-section. The oil flows thereafter while being heated over the pin surface, with half its flow to the right according to the FIG. 1 and the other half of its flow to the left. The oil stream flowing to the left is then passed into the hollow filler bodies and flows to the right to be united in the chamber 9 with the other oil stream and to flow out through the connecting piece 14. In order to obtain an equal oil stream in both directions, the resistance over the respective pin surface and the resistance for the returning part plus the resistance through the filler body must be equal. It is, therefore, necessary to pay regard to the resistance over the filler body when placing the oil flow, implying that the pin surface for the left-hand part of the heat exchanger is provided with about ten fewer pin rows than the other part.

When applying the embodiment according to FIGS. 5 and 7 for the heating of oil, the heat exchange function is carried out so that the oil is passed into the centre of the heat exchanger and divided into two streams, to the left and to the right, by flow through the upper one of the filler bodies. The divided oil stream then flows from both end chambers 19 and 20 to the centre of the heat exchanger and is re-collected in the cross-section at the centre of the heat exchanger having no pins and flows out through the opening 21. The filler bodies 18 preferably are formed thereby that a square casing encloses the pins and pin tubes so, that chambers of cross-section segment shape are formed between said square casing and the inner surface of the heat exchanger casing 1. By positioning the oil inlet on the outside of the square casing, the casing is pressed by the pressure drop against the pin tubes, and the square casing, therefore, can be made of a thin wall material. In addition thereto, at this embodiment as at the previous embodiment the oil flow is divided into two flows, and the embodiment, therefore, is suitable for great oil quantities and low pressure drop. The oil inlet connecting piece, further can be positioned on any one of the segments, i.e. with connection to any one of the filler bodies 18, and it also can be moved to the desired position along the shell. As already mentioned, the square casing about the tubes can be made of a thin material and thereby is adaptive when the tube set is being drawn out of the heat exchanger.

What I claim is:

1. A device at a heat exchanger for two media, comprising parallel tubes with surface-enlarging pins and flown through by one of the media and flown about by the second medium in a direction substantially in parallel with the first medium, which tubes are positioned in a casing with a chamber at each end and are so arranged, that the longitudinal passageways with projecting pins between the tubes connect the two chambers, and filler bodies are provided in the spaces between the tubes and the casing having no projecting pins, characterized in that at least some of the filler bodies are hollow at their ends and open each into one of said chambers, that the connecting opening for each inlet or outlet for the medium flowing between the tubes is positioned through the casing in a point between the two chambers and so, that in this point the entire cross-section provided with pins communicates with the connecting opening.

2. A device according to claim 1, characterized in that the inlet and outlet for the medium flowing between the tubes are positioned in the middle between said chambers, and that the inlet communicates with at least one of the hollow filler bodies, so that the medium is thereby distributed to the two chambers, and that the outlet extends from the area inside of the filler bodies to the connection outside of the casing.

3. A device according to claim 2, characterized in that the tubes are provided in a square cross-section, with filler bodies of cross-section segment shape positioned between the tubes and the casing.

4. A device according to claim 1, characterized in that the pins are removed from the tubes across the heat exchanger at either the inlet or outlet positioned at the centre of the exchanger.

5. An improved heat exchanger apparatus for two media, comprising parallel tubes with surface-enlarging pins and having one of the media flowing therethrough and the second medium flowing in a direction substantially in parallel with the first medium, which tubes are positioned in a casing with a chamber at each end and being arranged that longitudinal passageways with projecting pins between the tubes connect the two chambers, the improvement comprising: providing fillerbodies at least some of which are hollow and which are provided circumferentially in the casing between the tubes and the casing wall defining a space occupied by the tubes and formed by the longitudinal passageways, and having the second medium supplied into the casing through an inlet for division into two substantially equal part-flows moving in opposite directions in the space, at least one of the part-flows is wholly directed through the hollow fillerbodies.

6. An apparatus according to claim 5, wherein: the inlet for the medium flowing between the tubes is positioned in the middle between said chambers and communicates with the space between the tubes, and the outlet is positioned at one end connecting with the chamber in proximity thereto, whereby the medium is distributed within the heat exchanger to flow to the two chambers and is passed from one chamber to the chamber provided with connection to the outlet.

7. An apparatus according to claim 4, wherein the cross-section of the interior of the heat exchanger defined by the pin points is a regular polygon.

* * * * *